US006748864B2

(12) United States Patent
Verschueren et al.

(10) Patent No.: US 6,748,864 B2
(45) Date of Patent: Jun. 15, 2004

(54) APPARATUS FOR AUTOMATIC PLATE COATING AND CLEANING

(75) Inventors: Eric Verschueren, Merksplas (BE); Rudi Goedeweeck, Rotselaar (BE)

(73) Assignee: Agfa-Gevaert (BE)

( * ) Notice: Subject to any disclaimer, the term of this patent is extended or adjusted under 35 U.S.C. 154(b) by 24 days.

(21) Appl. No.: 10/010,697

(22) Filed: Nov. 8, 2001

(65) Prior Publication Data

US 2002/0056391 A1 May 16, 2002

Related U.S. Application Data

(60) Provisional application No. 60/252,550, filed on Nov. 22, 2000.

(30) Foreign Application Priority Data

Nov. 14, 2000 (EP) ..... 00203967

(51) Int. Cl.[7] ..... B41C 1/10; B41N 3/00

(52) U.S. Cl. ..... 101/463.1; 101/467; 101/477; 101/478; 101/424

(58) Field of Search ..... 101/450.1, 463.1, 101/465–467, 477, 478, 423–425

(56) References Cited

U.S. PATENT DOCUMENTS 4,443,531 A * 4/1984 Yamada et al. ..... 430/309
4,718,340 A * 1/1988 Love, III ..... 101/467
5,213,041 A 5/1993 Kanck
5,308,746 A * 5/1994 Barnett et al. ..... 430/302
5,623,877 A * 4/1997 Muth ..... 101/477
5,713,287 A 2/1998 Gelbart
6,082,263 A * 7/2000 Koguchi et al. ..... 101/467
6,085,657 A * 7/2000 Rombult et al. ..... 101/477

FOREIGN PATENT DOCUMENTS

EP 0 802 457 A1 10/1997
EP 940252 * 9/1999
JP 0116992 6/1989

* cited by examiner

*Primary Examiner*—Stephen R. Funk
(74) *Attorney, Agent, or Firm*—Leydig, Voit & Mayer, Ltd.

(57) ABSTRACT

An off-press plate-making apparatus is provided which comprises an apparatus for removing the lithographic image from the substrate of a used printing master and an apparatus for recoating the recycled substrate with a new image-recording layer. The off-press cleaning and recoating of the substrate provides a short press down-time. The recoated substrate forms an imaging material which can be exposed either on-press in a digital press comprising an integrated exposure apparatus or off-press in an exposure apparatus, which can be integrated in the plate-making apparatus or mechanically coupled thereto.

7 Claims, 3 Drawing Sheets

APPARATUS FOR AUTOMATIC PLATE COATING AND CLEANING

This application claims the benefit of U.S. Provisional Patent Application No. 60/252,550, filed Nov. 22, 2000, which is incorporated by reference.

FIELD OF THE INVENTION

The present invention relates to an apparatus for making a printing master, which carries a lithographic image on a substrate. More specifically the apparatus comprises means for removing the lithographic image from the substrate of the printing master and for coating the recycled substrate with a new image-recording layer that is capable of forming a lithographic image upon exposure to heat or light and optional processing.

BACKGROUND OF THE INVENTION

Lithographic printing presses use a so-called printing master such as a printing plate which is mounted on a cylinder of the printing press. The master carries a lithographic image on its surface and a print is obtained by applying ink to said image and then transferring the ink from the master onto a receiver material, which is typically paper. In conventional lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-abhesive (ink-repelling) areas and during driographic printing, only ink is supplied to the master.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently:

(i) On-press imaging. A special type of a computer-to-plate process involves the exposure of a plate precursor while being mounted on a plate cylinder of a printing press by means of an image-setter that is integrated in the press. This method may be called 'computer-to-press' and printing presses with an integrated plate-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. Typical plate materials used in computer-to-press methods are based on ablation. A problem associated with ablative plates is the generation of debris which is difficult to remove and may disturb the printing process or may contaminate the exposure optics of the integrated image-setter. Other methods require wet processing with chemicals which may damage or contaminate the electronics and optics of the integrated image-setter and other devices of the press.

(ii) On-press coating. Whereas a plate precursor normally consists of a sheet-like support and one or more functional coatings, computer-to-press methods have been described, e.g. in GB1546532, wherein a composition, which is capable to form a lithographic surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure. The latter method requires a curing step and the polymers are quite expensive because they are thermally unstable and therefore difficult to synthesize.

(iii) Thermal imaging. Most of the computer-to-press methods referred to above use so-called thermal or heat-mode materials, i.e. plate precursors or on-press coatable compositions which comprise a compound that converts absorbed light into heat. The heat which is generated on image-wise exposure triggers a (physico-)chemical process, such as ablation, polymerization, insolubilization by cross-linking of a polymer, decomposition, or particle coagulation of a thermoplastic polymer latex, and after optional processing, a lithographic image is obtained.

(iv) The development of functional coatings which require no wet processing or may be processed with plain water, ink or fountain is another major trend in plate-making. Such materials are especially desired in computer-to-press methods so as to avoid damage or contamination of the optics and electronics of the integrated image-setter by contact with the processing liquids. WO 90002044, WO 91008108 and EP-A 580 394 disclose such plates, which are, however, all ablative plates having a multi-layer structure which makes them less suitable for on-press coating. A non-ablative plate which can be processed with plain water is described in e.g. EP-A 770 497 and EP-A 773 112. Such plates also allow on-press processing, either by wiping the exposed plate with water while being mounted on the press or by the ink or fountain solution applied during the first runs of the printing job.

A computer-to-press method that is characterized by most of the above advantages has been disclosed in EP-A 698 488. An oleophilic substance is image-wise transferred from a foil to a rotary press cylinder by melting said substance locally with a laser beam. The strip-shaped transfer foil has a narrow width compared to the cylinder and is translated along a path which is parallel to the axis of the cylinder while being held in close contact with the surface of the cylinder so as to build up a complete image on that surface gradually. As a result, this system is rather slow and requires a long down-time of the printing press, thereby reducing its productivity.

EP-A 802 457 describes an on-press coating method wherein an aqueous liquid, comprising a hydrophilic binder, a compound capable of converting light to heat and hydrophobic thermoplastic polymer particles, is coated on the plate cylinder so as to form a uniform, continuous layer thereon. Upon image-wise exposure, areas of the coated layer are converted into an hydrophobic phase, thereby defining the printing areas of the printing master. The press run can be started immediately after exposure without any additional treatment because the layer is processed by interaction with the fountain and ink that are supplied to the cylinder during the press run. So the wet chemical processing of these materials is 'hidden' to the user and accomplished during the first runs of the printing press. After the press run, the coating can be removed from the plate cylinder by an on-press cleaning step. Such methods of on-press coating, on-press exposure and on-press cleaning of the master attract attention because, contrary to conventional lithographic printing, they can be carried out without specialized training or experience. Such presses function more or less like a desktop computer printer and require less human intervention than conventional presses.

A problem associated with the on-press coating, exposure and cleaning methods is that the wet coating and cleaning steps involve a risk of damaging or contaminating the optics and electronics of the integrated image-setter. In addition, the method produces an insufficient coating quality, characterized by a low consistency and a high frequency of coating artifacts, because the printing press is a hostile environment to the application of defect-free coatings due to paper dust, ink misting, and temperature or humidity variations. The quality of the wet-coating step can only be improved by installing a complex and sophisticated coating apparatus on the press, which is difficult to achieve due to space and cost limitations. Finally, during the on-press coating, exposure and cleaning steps, the press is not printing and the press down-time needs to be minimized in order to be economically viable.

SUMMARY OF THE INVENTION

It is an object of the present invention to provide an apparatus which enables to clean a printing master effectively and to apply a new, high-quality coating on the recycled substrate without a long press down-time. This object is realized by a printing system as described herein. According to the present invention, an off-press plate-making apparatus is provided which comprises means for removing the lithographic image from the substrate of a used printing master and means for recoating the recycled substrate thus obtained with a new image-recording layer. The press down-time is minimal because during a press run, the printing master(s) of the previous print job can be cleaned and the recycled substrate thus obtained can be recoated in the off-press plate-making apparatus for use in a next press run.

The recoated substrate forms an imaging material which can be exposed either on-press in a digital press comprising an integrated exposure apparatus or by an off-press exposure apparatus, which can be integrated in the plate-making apparatus or mechanically coupled thereto. On-press exposure offers the benefit of obtaining a perfect registration of the masters in multi-color presses immediately after exposure, whereas off-press exposure provides a shorter press down-time.

The plate-making apparatus can be mechanically coupled to a printing press so that the used printing master and the recoated substrate are automatically transferred between the press and the plate-making apparatus. By using an optional stacking apparatus between the plate-making apparatus and the press, a single plate-making apparatus can be combined with a multi-color printing press which requires more than one printing master. Such a printing system enables a fully-automated workflow of coating, exposure, printing and cleaning wherein the press down-time is minimal and which can be carried out without special skills.

Further advantages and embodiments of the present invention will become apparent from the following description and drawings. Preferred embodiments of the invention are disclosed in the dependent claims.

DETAILED DESCRIPTION OF THE INVENTION

Figure 1:
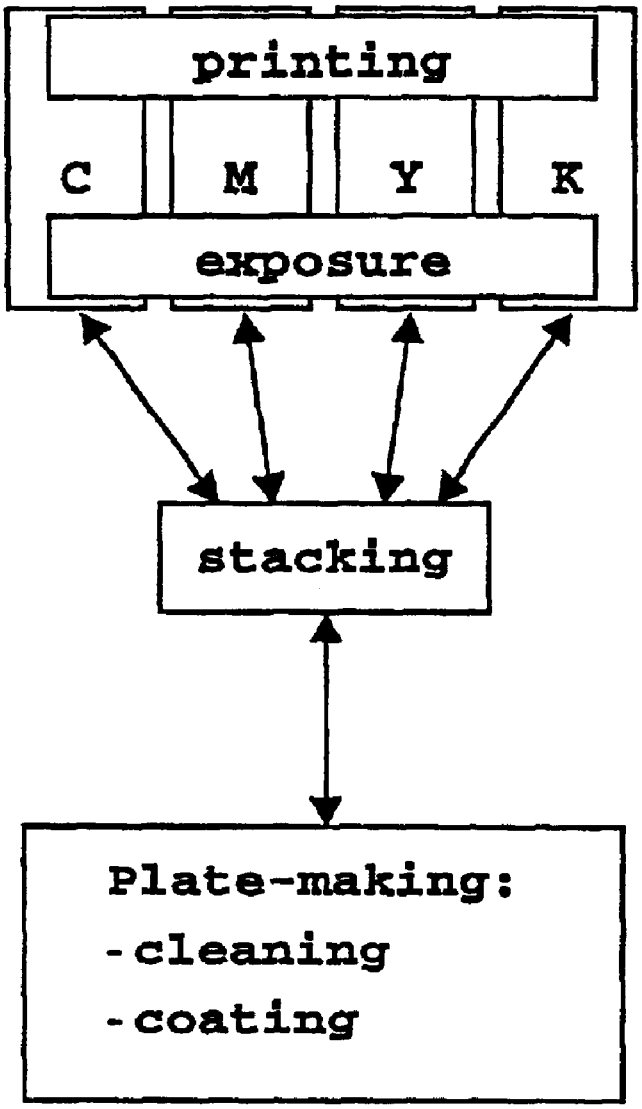
FIG. 1 shows schematically a preferred embodiment of a printing system according to the present invention wherein an on-press exposure apparatus is used.

In addition to the terms that have been defined in the background description, some relevant terms used herein shall be understood as follows:

- off-press apparatus: an apparatus that is not integrated in the printing press but located nearby the printing press and which may be mechanically coupled to the printing press; the apparatus may operate while the press is printing.
- on-press apparatus: an apparatus that is integrated in the printing press; the operation of the apparatus requires that the press is not printing.
- (mechanical) transferring means : means for moving, transporting or conveying a material such as a substrate, an imaging material or a printing master from one apparatus to another.
- color station: a unit of a printing press which is used for printing one color; a lithographic color station normally comprises a plate cylinder for carrying a printing master, a blanket cylinder which transfers the ink from the printing master to paper and an impression cylinder which presses the paper against the blanket cylinder.
- plate-making: as discussed below in the section regarding the substrate, the term "plate" should be construed broadly, i.e. meaning not only sheet-like materials but also cylindrical elements.

The plate-making apparatus of the present invention can be used according to the following method:

(a) coating: making an imaging material by applying an image-recording layer on a substrate by means of the off-press plate-making apparatus; the layer is a continuous layer which is capable of forming an image upon exposure to heat or light and optional processing.

(b) exposing: making a printing master having a lithographic image by exposing the image-recording layer to heat or light by means of an off-press or an on-press exposure apparatus and optional processing;

(c) printing: supplying ink to the lithographic image and transferring the ink from the lithographic image to paper or another receiver material by means of a printing press;

(d) cleaning: removing the lithographic image from the substrate in the off-press plate-making apparatus, thereby obtaining a recycled substrate;

(e) reusing the recycled substrate in a next cycle of coating, exposing and printing.

Between steps (a) and (c), the imaging material is transferred from the plate-making apparatus to the printing press, either after or before being exposed and optionally processed. Between steps (c) and (d), the used printing master is transferred from the printing press back to the plate-making apparatus. These transfers of material can be done manually, i.e. by an operator who carries the material from one apparatus to another. However, according to a preferred embodiment, the transfer is performed by transferring means which mechanically couple one apparatus to another. The transferring means which transfer material from the plate-making apparatus to the printing press are referred to herein as plate-loading means. The transferring means which transfer the used printing master from the press back to the plate-making apparatus are referred to herein as plate-unloading means.

Figure 2:
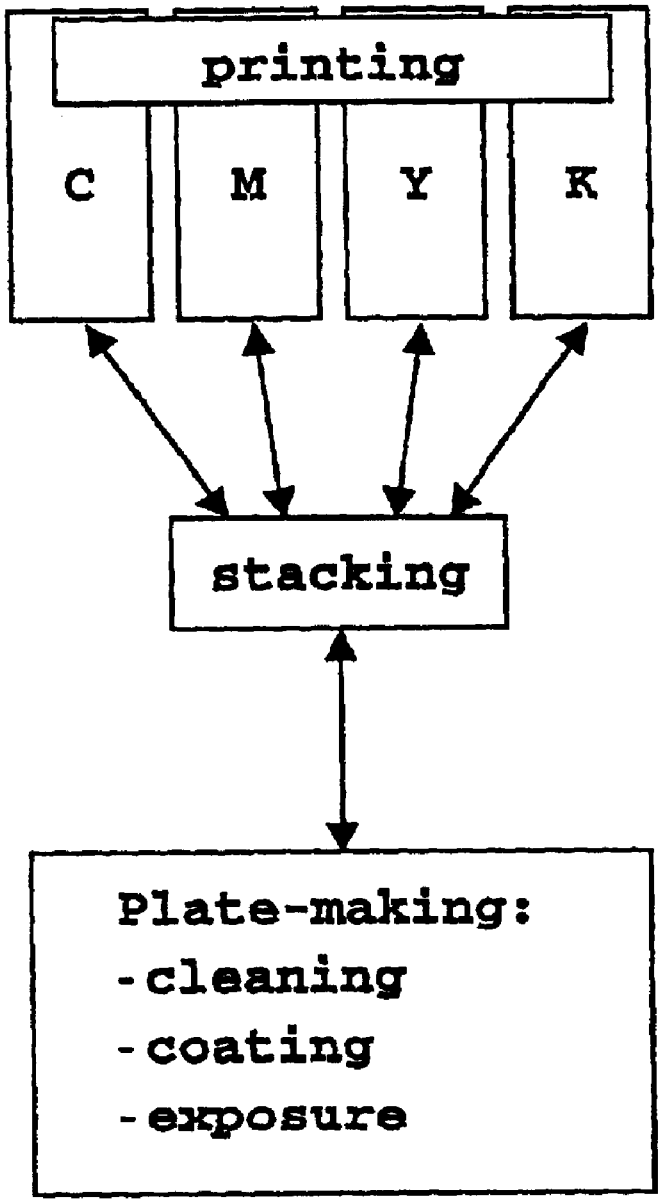
FIG. 2 shows schematically another preferred embodiment of a printing system according to the present invention wherein an off-press exposure apparatus is used that is integrated in the plate-making apparatus.
Figure 3:
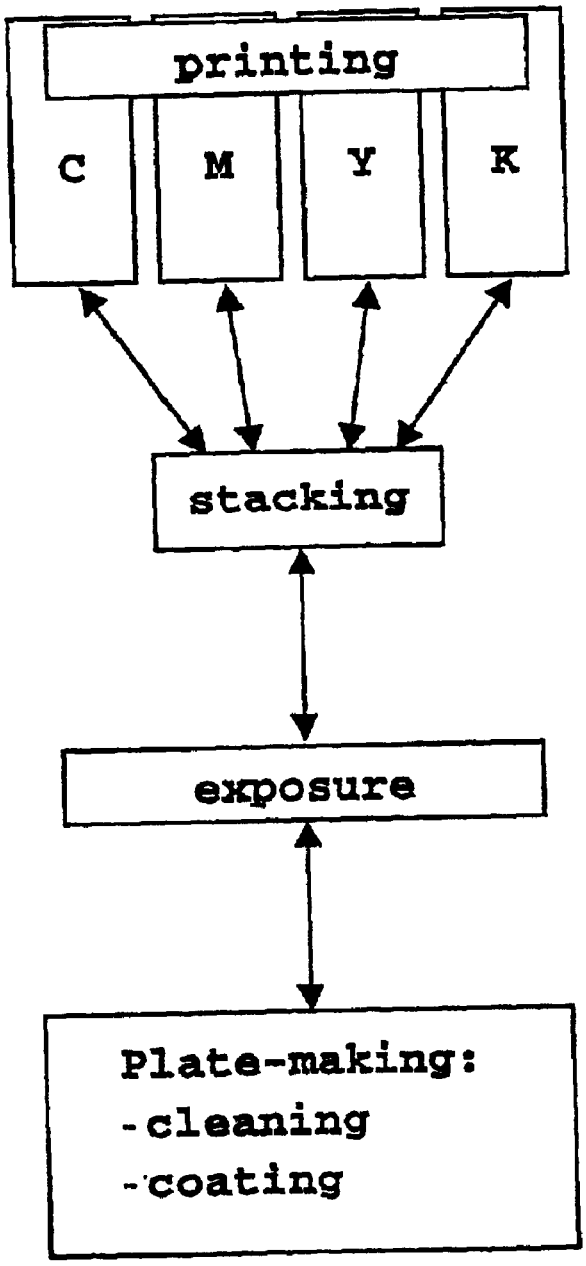
FIG. 3 shows schematically still another preferred embodiment of a printing system according to the present invention wherein an off-press exposure apparatus is used that is not integrated in the plate-making apparatus.

The exposure apparatus can be integrated in the press (such an embodiment is shown in FIG. 1), or integrated in the plate-making apparatus (FIG. 2), or be a separate apparatus that may be mechanically coupled with the plate-making apparatus and the printing apparatus (FIG. 3). In case the imaging material is sensitive to daylight, the mechanical transferring means between the plate-making apparatus and the exposure apparatus and between the exposure apparatus and the printing press should be light-tight, unless the exposure apparatus is mechanically coupled to a processing apparatus wherein the exposed imaging material is processed so as to form a printing master which is no longer sensitive to daylight.

The plate-making apparatus is preferably a single apparatus which performs both steps of cleaning and coating. Said single apparatus may comprise different sections for cleaning and coating and then it is preferred that the apparatus further comprises internal means for mechanically transferring the substrate from the cleaning section to the coating section. Alternatively, the plate-making apparatus may be an assembly of two distinct apparatuses, one for cleaning and one for coating. According to the latter embodiment, the recycled substrate is transferred between steps (d) and (a) from the cleaning apparatus to the coating apparatus either manually, but preferably mechanically by transferring means which couple the cleaning apparatus to the coating apparatus. During such transfer, the recycled substrate is preferably shielded from the environment so as to avoid contamination or damage of its surface. Transferring means which transfer the substrate between step (d) and (a) preferably shield the substrate from dust, so as to avoid pinholes and other artifacts in the recoated image-recording layer.

In a preferred embodiment according to the present invention, the plate-making apparatus comprises means for coating, cleaning, exposing and optionally also processing so that all the steps (a) coating, (b) exposure and (d) cleaning can be performed in the same apparatus, e.g. by mounting a printing master on the external surface of a rotating drum and cleaning the master by means of a cleaning head which travels over the master in the axial direction of the drum which rotates in the angular direction, then coating the recycled substrate by means of a coating head (travelling in a similar direction over the substrate) and finally exposing the coated layer by means of e.g. a laser head. The cleaning head, the coating head and the laser head may be coupled to one another, so as to form a multi-functional head which enables to perform the steps of cleaning, coating and exposing in a single pass of the multi-functional head over the substrate. More details and other means for coating, cleaning and exposing are given below.

Alternatively, the plate-making apparatus may contain a coating section, an exposure section and a cleaning section with internal mechanical means for transferring the material between the different sections of the apparatus. Such a plate-making apparatus may handle three materials at once by the simultaneous operation of all sections: coating a substrate, exposing an image-recording material and cleaning a printing master.

The plate-making apparatus and the printing press form together a printing system, which may optionally also contain one or more stacking apparatuses. The printing press can be a single-color or a multi-color press, which comprises a plurality of color stations (the number of color stations typically ranges from 2 to 6, or even 12 in case of six-color duplex printing). Especially when the printing press is a multi-color press, it is very advantageous to include a stacking apparatus in the plate-loading means which transfer the imaging material from the plate-making apparatus to the printing press, and/or in the plate-unloading means which transfer the used printing master from the printing press back to the plate-making apparatus. Such a stacking apparatus enables to coat, expose and/or clean materials for all the color stations with a single plate-making and/or a single off-press exposure apparatus, because the stacking apparatus acts as a buffer for temporary storage between one apparatus and the next apparatus in the cycle. Alternatively, a stacking apparatus may be integrated inside an apparatus, either at the entry and/or the exit thereof, rather than in the transferring means between two apparatuses.

Particularly preferred configurations of the present invention comprise (i) a plate-making apparatus which is coupled to a multi-color digital press (containing an integrated exposure apparatus in each color station) via a stacking apparatus (FIG. 1); (ii) a plate-making apparatus with integrated exposure apparatus (and optional processor) that is coupled to a multi-color printing press via a stacking apparatus (FIG. 2); and (iii) a plate-making apparatus coupled to an exposure apparatus (with optional processor), which is coupled to a multi-color printing press via a stacking apparatus (FIG. 3).

As an example of configuration (i), a digital four-color press for printing the basic colors Cyan (C), Magenta (M), Yellow (Y) and Black (K), is combined with a single plate-making apparatus via a stacking apparatus. The plate-making apparatus first prepares an imaging material for e.g. the C color station and that material is then transferred to the stacking apparatus which temporarily stores the material while the printing press is running a previous print job. Subsequently, the material for another color selection, e.g. M, is coated and also stored in the stacking apparatus. Similarly, the imaging materials for the Y and K stations are prepared and stored in the stacking apparatus until the previous press run is finished. Then, the used printing masters are removed from the press and mechanically transferred to the plate-making apparatus for cleaning (also preferably via an intermediate stacking apparatus present in the plate-unloading means), and finally, the materials for the next print job are mechanically transferred from the stacking apparatus to the respective color stations C, M, Y and K, where they are exposed by the integrated exposure apparatus.

In configurations (ii) and (iii), the printing system of the present invention comprises a plate-making apparatus with an integrated exposure apparatus or which is coupled to a separate off-press exposure apparatus. In such case, the stacking apparatus between the exposure apparatus and the multi-color press and the plate-loading means between the exposure apparatus and the press are preferably equipped with some intelligence, e.g. driven by a microcomputer, to ensure that each color selection arrives at the correct color station. In the most preferred embodiment of a printing system comprising a multi-color press, a single stacking apparatus handles the image-recording materials prepared by the plate-making apparatus (or the exposed materials in case of off-press exposure) as well as the used printing masters which need to be transferred back to the plate-making apparatus for cleaning.

Before turning to the detailed discussion of the various elements of the present invention, it should now be clear to the skilled person that many variations of the present invention are possible.

The Substrate

The substrate used in the present invention may have any affinity for ink and/or an ink-abhesive fluid such as dampening liquid. A driographic material can be obtained by providing an ink-abhesive substrate with an ink-accepting image-recording layer, or an image-recording layer which becomes ink-accepting after exposure, and optional processing. Alternatively, a driographic material can also be obtained by providing an ink-accepting substrate with an ink-abhesive image-recording layer, or an image-recording layer which becomes ink-abhesive after exposure, and optional processing. A conventional lithographic material can be obtained by providing a hydrophilic substrate with a hydrophobic image-recording layer, or an image-recording layer which becomes hydrophobic after exposure and optional processing. Alternatively, a conventional lithographic material can also be obtained by providing a hydrophobic substrate with a hydrophilic image-recording layer, or an image-recording layer which becomes hydrophilic after exposure and optional processing.

According to still another embodiment, the affinity of the substrate for ink or for an ink-abhesive fluid is irrelevant, more particularly when the substrate is coated with a so-called switchable image-recording layer, which can be switched from one ink affinity to another and remains on the substrate after exposure and optional processing in the exposed as well as the non-exposed areas. In this embodiment, the printing as well as the non-printing areas are mainly defined by the coated layer and not by the substrate. More details about switchable layers, more particularly switchable polymers, are given in the section "imaging material" below.

The substrate may be a sheet-like material such as a plate or it may be a cylindrical element such as a sleeve. In the latter option, the printing plate may be soldered in a cylindrical form, e.g. by means of a laser. Such cylindrical printing plate can be slid on the print cylinder of a printing press instead of being mounted thereon such as a conventional printing plate. More details on sleeves are given in e.g. "Grafisch Nieuws", 15, 1995, page 4–6.

The substrate may be an aluminum support. A particularly preferred substrate is an electrochemically grained and anodized aluminum support. The anodized aluminum support may be treated to improve the hydrophilic properties of its surface. For example, the aluminum support may be silicated by treating its surface with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde. It is further evident that one or more of these post treatments may be carried out alone or in combination. More detailed descriptions of these treatments are given in GB-A-1 084 070, DE-A-4 423 140, DE-A-4 417 907, EP-A-659 909, EP-A-537 633, DE-A-4 001 466, EP-A-292 801, EP-A-291 760 and U.S. Pat. No. 4,458,005.

According to another embodiment, the substrate can also be a flexible support, which is provided with a hydrophilic layer, hereinafter called 'base layer'. The flexible support is e.g. paper, plastic film or aluminum. Preferred examples of plastic film are polyethylene terephthalate film, polyethylene naphthalate film, cellulose acetate film, polystyrene film, polycarbonate film, etc. The plastic film support may be opaque or transparent.

The base layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic base layer may vary in the range of 0.2 to 25 $\mu$m and is preferably 1 to 10 $\mu$m.

The hydrophilic binder for use in the base layer is e.g. a hydrophilic (co)polymer such as homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60% by weight, preferably 80% by weight.

The amount of hardening agent, in particular tetraalkyl orthosilicate, is preferably at least 0.2 wt. parts per wt. part of hydrophilic binder, more preferably between 0.5 and 10 parts per part, most preferably between 3 and 8 parts per part.

The hydrophilic base layer may also contain substances that increase the mechanical strength and the porosity of the layer. For this purpose colloidal silica may be used. The colloidal silica employed may be in the form of any commercially available water dispersion of colloidal silica for example having an average particle size up to 40 nm, e.g. 20 nm. In addition inert particles of larger size than the colloidal silica may be added e.g. silica prepared according to Stober as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the hydrophilic base layer is given a uniform rough texture consisting of microscopic hills and valleys, which serve as storage places for water in background areas.

Particular examples of suitable hydrophilic base layers for use in accordance with the present invention are disclosed in EP-A-601 240, GB-P-1 419 512, FR-P-2 300 354, U.S. Pat. No. 3,971,660, and U.S. Pat. No. 4,284,705.

It is particularly preferred to use a film support to which an adhesion improving layer, also called subbing layer, has been provided. Particularly suitable adhesion improving layers for use in accordance with the present invention comprise a hydrophilic binder and colloidal silica as disclosed in EP-A-619 524, EP-A-620 502 and EP-A-619 525. Preferably, the amount of silica in the adhesion improving layer is between 200 mg/m$^2$ and 750 mg/m$^2$. Further, the ratio of silica to hydrophilic binder is preferably more than 1 and the surface area of the colloidal silica is preferably at least 300 m$^2$/gram, more preferably at least 500 m$^2$/gram.

The Imaging Material

The imaging material consists of at least one image-recording layer provided on the substrate. Preferably, only a single layer is provided on the substrate. The material may be light- or heat-sensitive, the latter being preferred because of daylight-stability. In principle, any known direct-to-plate material is suitable, especially in the embodiment comprising an off-press exposure apparatus. For materials which require processing after exposure, the exposure apparatus can be mechanically coupled to or may comprise a processor. Known materials which require processing are e.g. light-sensitive plates such as photopolymer plates and silver diffusion transfer plates, or heat-sensitive (so-called thermal) plates which rely on e.g. heat-induced solubilization of a polymer layer or heat-induced release of an acid which triggers cross-linking of a polymer layer (insolubilization).

Highly preferred imaging materials for use in the present invention have an image-recording layer which does not require any processing so that a printing master is obtained immediately after exposure. This is especially advantageous in the embodiment using on-press exposure. Alternatively, the material may be processed on-press, e.g. by supplying an aqueous liquid, fountain and/or ink (so-called 'hidden processing').

Processless materials can be based on various mechanisms.

Ablative plates typically use layers which may be removed by high-energy infrared laser exposure, e.g. metal layers, or thermally unstable layers which may contain self-oxidizing polymers such as nitrocellulose. Typical ablative materials are disclosed in EP 628 409; WO98/55330; U.S. Pat. No. 5,401,611; DE 19 748 711; U.S. Pat. No. 5,605,780; U.S. Pat. No. 5,691,114, WO97/00735; U.S. Pat. No. 4,054,094 and EP 882 582. Non-ablative processless plates comprise e.g. switchable polymers (e.g. EP 924 102) which can be image-wise converted from a hydrophobic state to a hydrophilic state (WO92/09934; EP 652 483) or vice-versa (U.S. Pat. No. 4,081,572; EP 200,488, EP 924 065). Other examples of processless plates are based on the thermally induced rupture of microcapsules and the subsequent reaction of the microencapsulated oleophilic materials (isocyanates) with functional (hydroxyl-)groups on cross-linked hydrophilic binders (U.S. Pat. No. 5,569,573; EP 646 476; WO94/2395; WO98/29258).

A most preferred composition of the imaging layer relies on the heat-induced coalescence of hydrophobic thermoplastic polymer particles in a hydrophilic binder, as described in e.g. EP 770 494; EP 770 495; EP 770 497; EP 773 112; EP 774 364; and EP 849 090. These materials are especially designed for on-press ("hidden") processing by ink and/or fountain. The coalesced polymer particles define a hydrophobic, printing area and do not dissolve in ink or fountain whereas the unexposed layer readily dissolves in ink and/or fountain. The components (thermoplastic polymer latex and hydrophilic binder) of the latter embodiment will now be described in more detail.

Hydrophobic thermoplastic polymer particles preferably have a coagulation temperature above 35° C. and more preferably above 50° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition of the polymer particles. Preferably the coagulation temperature is at least 10° C. below the temperature at which the decomposition of the polymer particles occurs. Specific examples of hydrophobic polymer particles are e.g. polyethylene, polyvinyl chloride, polymethyl (meth)acrylate, polyethyl (meth) acrylate, polyvinylidene chloride, polyacrylonitrile, polyvinyl carbazole, polystyrene or copolymers thereof. Most preferably used is polystyrene. The weight average molecular weight of the polymers may range from 5,000 to 1,000,000 g/mol. The hydrophobic particles may have a particle size from 0.01 $\mu$m to 50 $\mu$m, more preferably between 0.05 $\mu$m and 10 $\mu$m and most preferably between 0.05 $\mu$m and 2 $\mu$m. The amount of hydrophobic thermoplastic polymer particles contained in the image forming layer is preferably between 20% by weight and 65% by weight and more preferably between 25% by weight and 55% by weight and most preferably between 30% by weight and 45% by weight.

The polymer particles are present as a dispersion in an aqueous coating liquid of the image forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

Suitable hydrophilic binders are for example synthetic homo or copolymers such as a polyvinylalcohol, a poly (meth)acrylic acid, a poly(meth)acrylamide, a polyhydroxyethyl(meth)acrylate, a polyvinylmethylether or natural binders such as gelatin, a polysaccharide such as e.g. dextran, pullulan, cellulose, arabic gum, alginic acid.

The imaging layer based on heat-induced polymer latex coalescence is preferably an infrared-sensitive layer containing one or more compounds that are capable of converting infrared light into heat. Particularly useful compounds are for example infrared dyes, carbon black, metal carbides, borides, nitrides, carbonitrides, bronze-structured oxides, and conductive polymer dispersions such as polypyrrole, polyaniline or polythiophene-based conductive polymer dispersions.

Means for applying an image-recording layer on the substrate.

The plate-making apparatus comprises means for applying a image-recording layer on the substrate. The layer is a uniform layer. For obtaining the right coating thickness it may be necessary to repeat the coating several times on the same substrate.

The coating can be applied by heat- or friction-induced transfer from a donor material as described in EP 1 048 458, or by powder coating, e.g. as described in EP-A 974 455 and EP-A no. 99203682, filed on Nov. 3, 1999, or by coating a liquid solution according to any known coating method, e.g. spin-coating, dip coating, rod coating, blade coating, air knife coating, gravure coating, reverse roll coating, extrusion coating, slide coating and curtain coating. An overview of these coating techniques can be found in the book "Modern Coating and Drying Technology", Edward Cohen and Edgar B. Gutoff Editors, VCH publishers, Inc, New York, N.Y., 1992. It is also possible to apply the coating solution to the substrate by printing techniques, e.g. ink-jet printing, gravure printing, flexo printing, or offset printing. Ink-jet printing as described in EP-A no. 00202700, filed on Jul. 31, 2000, is highly preferred.

According to a most preferred embodiment, a coating solution is sprayed on the substrate by means of a head comprising a spray nozzle. Preferred values of the spraying parameters have been defined in EP-A no. 99203064 and EP-A no. 99203065, both filed on Sep. 15, 1999. In a preferred configuration, the substrate is mounted on the external surface of a drum and the spray head translates along the substrate in the axial direction while the drum is rotating in the angular direction.

Coating by spraying or jetting are the preferred techniques for applying a layer of the most preferred composition of the imaging layer, based on heat-induced coalescense of thermoplastic polymer particles in a hydrophilic binder, referred to above.

Means for exposing the image-recording layer to heat or light

According to one embodiment of the present invention, the imaging material is image-wise exposed by an off-press exposure apparatus and subsequently mounted on a print cylinder of a printing press. According to another embodiment, the imaging material is exposed on-press by an integrated exposure apparatus while being mounted on the print cylinder. The imaging materials used in the present invention are exposed to heat or to light, e.g. by means of a thermal head, LEDs or a laser head. Preferably, one or more lasers such as He/Ne or Ar lasers are used. Most preferably, the light used for the exposure is not visible light so that daylight-stable materials can be used, e.g. UV (laser) light or a laser emitting near infrared light having a wavelength in the range from about 700 to about 1500 nm is used, e.g. a semiconductor laser diode, a Nd:YAG or a Nd:YLF laser. The required laser power depends on the sensitivity of the image-recording layer, the pixel dwell time of the laser beam, which is determined by the spot diameter (typical value of modern plate-setters at $1/e^2$ of maximum intensity: 10–25 $\mu$m), the scan speed and the resolution of the exposure apparatus (i.e. the number of addressable pixels per unit of linear distance, often expressed in dots per inch or dpi; typical value: 1000–4000 dpi).

Two types of laser-exposure apparatuses are commonly used: internal (ITD) and external drum (XTD) plate-setters. ITD plate-setters are typically characterised by a very high scan speed up to 500 m/sec and may require a laser power of several Watts. XTD plate-setters having a typical laser power from about 200 mW to about 1 W operate at a lower scan speed, e.g. from 0.1 to 10 m/sec.

The known plate-setters can be used as an off-press exposure apparatus in the present invention. This offers the benefit of reduced press down-time. XTD plate-setter configurations can also be used for on-press exposure, offering the benefit of immediate registration in a multi-color press. More technical details of on-press exposure apparatuses are described in e.g. U.S. Pat. No. 5,174,205 and U.S. Pat. No. 5,163,368.

Means for Processing the Exposed Image-Recording Layer

As mentioned above, the need for a processor depends on the choice of the imaging material. Materials which require processing are preferably used in an off-press exposure apparatus, which may be mechanically coupled to or may comprise a processing apparatus. More preferably, processless materials are used or materials which can be processed on-press by supplying ink and/or fountain to the image-recording layer.

The materials which rely on heat-induced coalescence of hydrophobic thermoplastic polymer particles in a hydrophilic binder, as discussed above in the section "imaging material", are preferred examples which allow such 'hidden on-press processing' by ink and/or fountain. Such materials can be mounted on the press and, then, while the print cylinder with the imaging element mounted thereon rotates, the dampener rollers that supply dampening liquid are dropped on the imaging element and subsequent thereto the ink rollers are dropped. Generally, after about 10 revolutions of the print cylinder the first clear and useful prints are obtained. According to an alternative method for processing such materials, the ink rollers and dampener rollers may be dropped simultaneously or the ink rollers may be dropped first.

Suitable dampening liquids that can be used in connection with such materials are aqueous liquids generally having an acidic pH and comprising an alcohol such as isopropanol.

In combination with other materials, e.g. ablative imaging materials, it may be advantageous to wipe the image-recording layer of an image-wise exposed imaging material (to remove ablation debris) with e.g. a cotton pad or sponge soaked with water before or after mounting the imaging material on the press or at least before the printing press starts running.

Besides the optional processing step which may be necessary to obtain a lithographic image, other post-imaging treatments can be useful, such as a fixing step, a post-bake step, a gumming step, a rinsing step, etc. Means for carrying out these steps can be integrated in the processor. Before starting the printing press, the results from (optical) measurements carried out on the lithographic image of the printing master can be used for correction of the registration of the masters in a multi-color press or for adjusting the ink keys of the press.

Means for Removing the Lithographic Image From the Substrate.

In the plate-making apparatus, the ink-accepting areas of the used printing master are removed from the substrate by cleaning means. The cleaning step is preferably characterised by a low risk of deteriorating the lithographic surface of the substrate, yet also by an effective removal of the ink-accepting areas, which may be a difficult compromise to achieve. The cleaning means may be means for treating the surface of the substrate scan-wise, e.g. a laser head for cleaning by ablation or a cleaning head comprising a nozzle for jetting or spraying a cleaning liquid on the substrate. Alternatively, the cleaning can be done in dip-tanks holding a cleaning liquid wherein the printing master is dipped. The above means for cleaning can be combined with means for ultrasound treatment or mechanical cleaning means. Suitable mechanical means for cleaning the substrate are e.g. means for scraping the substrate, means for rubbing the substrate, e.g. a rotating brush, a cloth or another absorbing medium, which may be moistened with a cleaning liquid, or means for jetting water or a volatile medium such as air, a solvent or dry ice pellets.

A preferred cleaning liquid should be sufficiently effective, e.g. should be able to avoid the appearance of any ghost image after several cycles (preferably >10, most preferably >20) of coating, exposing, printing and cleaning.

Other preferred characteristics of the cleaning liquid are a low volatile organic content to avoid environmental contamination and inertness towards the hardware of the plate-making apparatus, e.g. it is preferably a liquid which does not affect rubber, seals or other materials used in the plate-making apparatus. Suitable cleaning liquid compositions which comply with the above requirements have been disclosed in EP-As no. 00200176, 00200177 and 00200178, all filed on Jan. 18, 2000.

For the cleaning of the most preferred imaging material, discussed above, which comprises hydrophobic thermoplastic polymer particles in a hydrophilic binder, the cleaning liquid is preferably an emulsion of an organic liquid in an aqueous liquid. The preparation of this emulsion is preferably carried out in the plate-making apparatus, which may comprise means for mixing an organic liquid with an aqueous liquid so as to form said emulsion, e.g. by stirring a mixture of a cyclic organic compound containing at least one double bond, an alcohol, water and an emulsifying agent. Preferably, the plate-making apparatus also comprises means for separating the emulsion (after use) into an organic phase and an aqueous phase, e.g. by heating the emulsion to induce phase-separation. The recycled water thus obtained can be used for preparing fresh emulsion or for rinsing the substrate after cleaning or prior to recoating.

The plate-making apparatus preferably also comprises means for rinsing the substrate after the cleaning step, e.g. means for supplying, e.g. spraying or jetting, water or an aqueous solution onto the substrate. The plate can then be dried by e.g. hot air, vacuum extraction or an absorbing medium such as a cloth.

The Transferring Means

The transferring means comprise a mechanism that is capable of moving, transporting or conveying the substrate, the imaging material or the used printing master from one apparatus to another. Such mechanisms are known in the art and widely used in plate-handling equipment. The transferring means may comprise conveyor belts, grippers, suction caps, rollers, chains, etc. When visible light-sensitive materials are to be transferred, the transferring means are preferably light-tight, i.e. capable of transferring the material while it is kept shielded from light (the same specification is valid for any other apparatus used in the present invention).

The plate-loading means preferably contain a mechanism which mounts the printing master to the plate cylinder. The plate-unloading means preferably contain a mechanism which removes the printing master from the plate cylinder. Plates are normally fixed to the cylinder by clamps, whereas sleeves are slid over the cylinder.

The Stacking Apparatus

The stacking apparatus acts as a buffer for temporary storage of a substrate, an imaging material or a printing master between one apparatus and the next apparatus in the cycle. Various characteristics of such an apparatus have already been discussed above. A stacking apparatus may be used in the means for mechanical transfer means from the plate-making apparatus to the exposure apparatus (which may be on-press or off-press), from an off-press exposure apparatus to the press and from the press back to the plate-making apparatus.

When used in the plate-loading means of a multi-color press, the stacking apparatus is preferably driven by a system that directs the right color selection at the right time to the right color station of the press. The stacking apparatus may also comprise means for adjusting and controlling the temperature and/or humidity in the apparatus and should be light-tight when handling light-sensitive materials.

The stacking apparatus between the off-press exposure apparatus and the press or between the plate-making apparatus and a digital press may also comprise means for bending and/or punching the substrate so that the material is ready for being mounted on the printing press. Also means for de-bending the substrate may be included in the stacking apparatus between the press and the plate-making apparatus. Such means for bending and de-bending may also be included in another apparatus of the present invention.

We claim:

1. A printing system comprising a multi-color lithographic printing press and an off-press plate-making apparatus comprising:

means for applying on a substrate a uniform image-recording layer which is capable of forming a lithographic image upon exposure to heat or light and optional processing; and means for removing the lithographic image from the substrate;

wherein the off-press plate-making apparatus is mechanically coupled to the multi-color printing press by plate-loading means for transferring a plurality of printing plate precursors or a plurality of printing masters from the plate-making apparatus to the multi-color printing press and/or by plate-unloading means for transferring a plurality of printing masters from the multi-color printing press to the plate-making apparatus and wherein the plate-loading means and/or the plate-unloading means comprise a stacking apparatus.

2. A printing system according to claim 1 which further comprises:

means for exposing the image-recording layer to heat or light; and, optionally, means for processing the exposed image-recording layer.

3. A printing system according to claim 1 wherein the means for applying a uniform image-recording layer on the substrate comprise a spray nozzle or an ink-jet nozzle for applying a coating solution on the substrate.

4. A printing system according to claim 1 wherein the means for removing the lithographic image from the substrate comprise a spray nozzle or an ink-jet nozzle for applying a cleaning liquid on the substrate.

5. A printing system according to claim 1 wherein the means for removing the lithographic image from the substrate further comprises a means for preparing an emulsion by mixing an organic liquid with an aqueous liquid.

6. A printing system according to claim 1 wherein the means for removing the lithographic image from the substrate further comprises a means for separating an emulsion in an organic phase and an aqueous phase.

7. A printing system according to claim 1 wherein the stacking apparatus is integrated in the off-press plate-making apparatus.

* * * * *